US006523522B1

(12) United States Patent
Costin

(10) Patent No.: US 6,523,522 B1
(45) Date of Patent: Feb. 25, 2003

(54) METHOD AND APPARATUS FOR OPERATING A THROTTLE PLATE MOTOR DRIVING A THROTTLE PLATE HAVING OPPOSING RETURN SPRINGS

(75) Inventor: Mark H. Costin, Bloomfield Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/934,944

(22) Filed: Aug. 22, 2001

(51) Int. Cl.[7] ..... F02D 41/00

(52) U.S. Cl. ..... 123/399; 123/361

(58) Field of Search ..... 123/399, 361, 123/362, 350, 319, 395

(56) References Cited

U.S. PATENT DOCUMENTS

| | | | | |
|---|---|---|---|---|
| 3,982,509 A | | 9/1976 | Colling et al. | |
| 4,911,125 A | | 3/1990 | Sugawara et al. | |
| 5,228,365 A | | 7/1993 | Koenig et al. | |
| 5,307,776 A | | 5/1994 | Unuvar et al. | |
| 5,505,527 A | | 4/1996 | Gray, Jr. et al. | |
| 5,967,118 A | * | 10/1999 | Hsu et al. | 123/399 |
| 6,033,042 A | | 3/2000 | Klemen | |
| 6,367,449 B1 | * | 4/2002 | Moteki et al. | 123/399 |

* cited by examiner

*Primary Examiner*—Bibhu Mohanty
(74) *Attorney, Agent, or Firm*—Anthony Luke Simon

(57) ABSTRACT method and apparatus for controlling throttle plate position by compensating for characteristics of return springs acting on the throttle plate and static friction against movement of the throttle plate. The spring characteristic compensation includes static spring force and non-linear spring action force compensation. The method also learns the spring force characteristics to compensate for differences in the return springs.

17 Claims, 5 Drawing Sheets

METHOD AND APPARATUS FOR OPERATING A THROTTLE PLATE MOTOR DRIVING A THROTTLE PLATE HAVING OPPOSING RETURN SPRINGS

BACKGROUND OF THE INVENTION

The present invention relates to electronic throttle control and, more specifically, to a method and apparatus for operating a throttle plate motor in a throttle plate assembly equipped with opposing return springs.

In internal combustion engine control, the movement of the throttle plate or blade by an electric motor which controls the opening and closing of the throttle plate through an angle corresponding to the amount of depression of an accelerator pedal is generally known. Typically, such control includes an actuator connected to a throttle valve or plate, such as a conventional butterfly valve, wherein valve position is adjusted by controlled actuator motion to provide appropriate restriction on the air passage into the engine. The actuator is in communication with a controller, which controls actuator motion when air is to be metered to the engine.

The controller may be responsive to any one of several factors used to formulate the current desired throttle position. For example, such factors may include inputs indicative of the engine operating conditions, an operator command from an accelerator pedal, information from an active cruise control algorithm, an active idle speed control algorithm, or an active traction control algorithm. Further, feedback may be provided to the controller from a conventional throttle valve position sensor communicating a signal to the controller, the magnitude of which is related to the degree of opening of the throttle valve or plate. Corrective positioning of the actuator or diagnostics may be carried out by the controller in response to the sensor feedback signal. At least one, and possibly two, opposing return springs act on the throttle plate to return the throttle plate to a default position in the absence of throttle control. This default position is generally selected so that if a fault is detected and the throttle de-energizes, the vehicle can run in a controlled limp home mode.

In internal combustion engines using electronic throttle control, it is desirable that the throttle plate position accurately track the accelerator pedal position with a high-speed response capability. However, the response capability of a throttle plate is affected by the return spring characteristics, including static spring forces, non-uniform spring constants and variations in the spring force of the springs over the full range of spring compression.

Thus, it would be desirable to provide a method for operating an electronic throttle position drive motor having opposing return springs which improves response in prior electronic throttle plate drive motor control with respect to variations in return spring characteristics.

SUMMARY OF THE INVENTION

The present invention adds unique compensation for return spring characteristics used in an electronic throttle position control for an internal combustion engine to improve the response of throttle position changes.

According to one aspect of the invention, a method controls an internal combustion engine throttle valve or plate by an actuator which is responsive to at least accelerator pedal position and throttle plate position. The throttle plate has opposing springs acting on the throttle plate to normally bias the throttle plate to a default position.

The method comprises the step of compensating for one of spring characteristics and static friction of the springs when moving the throttle plate to -a desired position within the range of movement of the throttle plate. Preferably, the method compensates for both the spring characteristics and static friction. More preferably, compensation is provided for spring characteristics, including at least one of static spring and non-linear spring forces.

The present method also learns the force characteristics of the springs over the range of movement of the springs.

In another aspect of the invention, an apparatus controls a throttle plate for controlling a throttle plate driven by an actuator. The apparatus includes means for sensing throttle plate position and a control for determining a desired throttle position. An actuator is responsive to the control for driving the throttle plate to the desired throttle position. The control includes compensating means for compensating for one of return spring characteristics and static friction of the throttle plate and return springs encountered when moving the throttle plate to the desired throttle position.

The compensating means includes means for compensating for static spring forces in the return springs and static friction of the return springs and the throttle plate.

Means are also provided for learning the spring force characteristics so as to adjust the spring force compensation based on variations in the construction of the return springs and wear during use of the return springs.

Implementation of the method and apparatus of the present invention uniquely provides compensation for various spring and friction related characteristics affecting responsive movement of a throttle plate to actuator commands. The method and apparatus also uniquely learn the spring characteristics, which, may vary from spring to spring and/or vary over time, to provide accurate compensation and throttle plate response.

BRIEF DESCRIPTION OF THE DRAWINGS

The various features, advantages and other uses of the present invention will become more apparent by referring to the detailed description and drawings in which:

FIG. 8 is a graph depicting throttle response to a set point change according to the present invention.

DETAILED DESCRIPTION OF THE PREFERRED EMBODIMENTS

Figure 1:
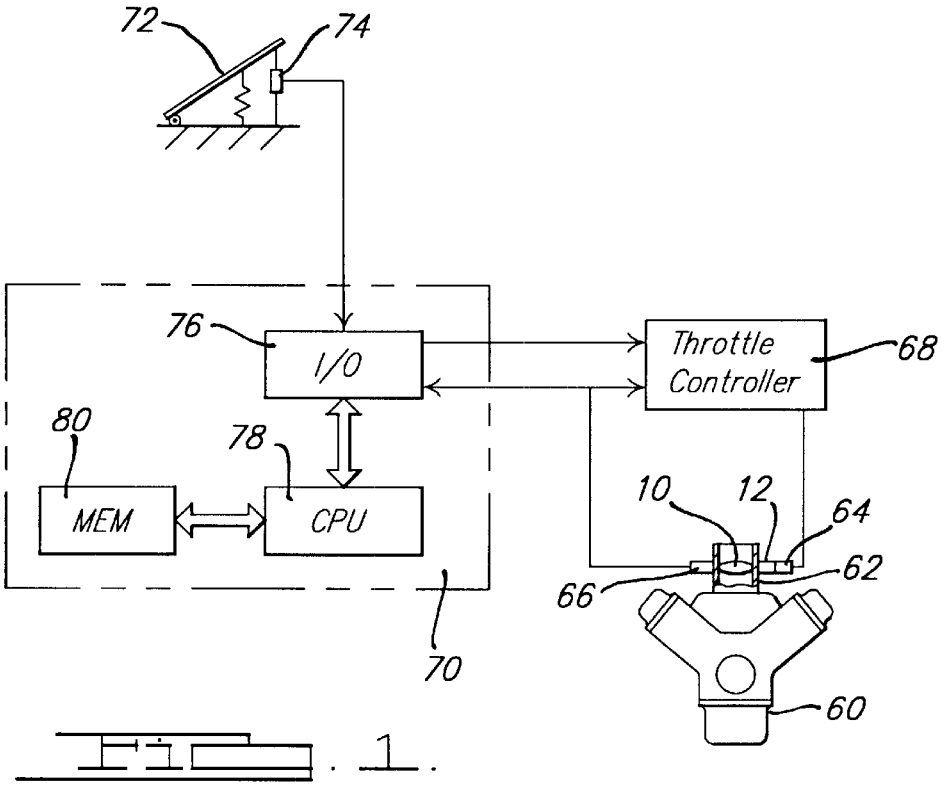
FIG. 1 is a general diagram of the main elements used to carry out the present invention.
Figure 2:
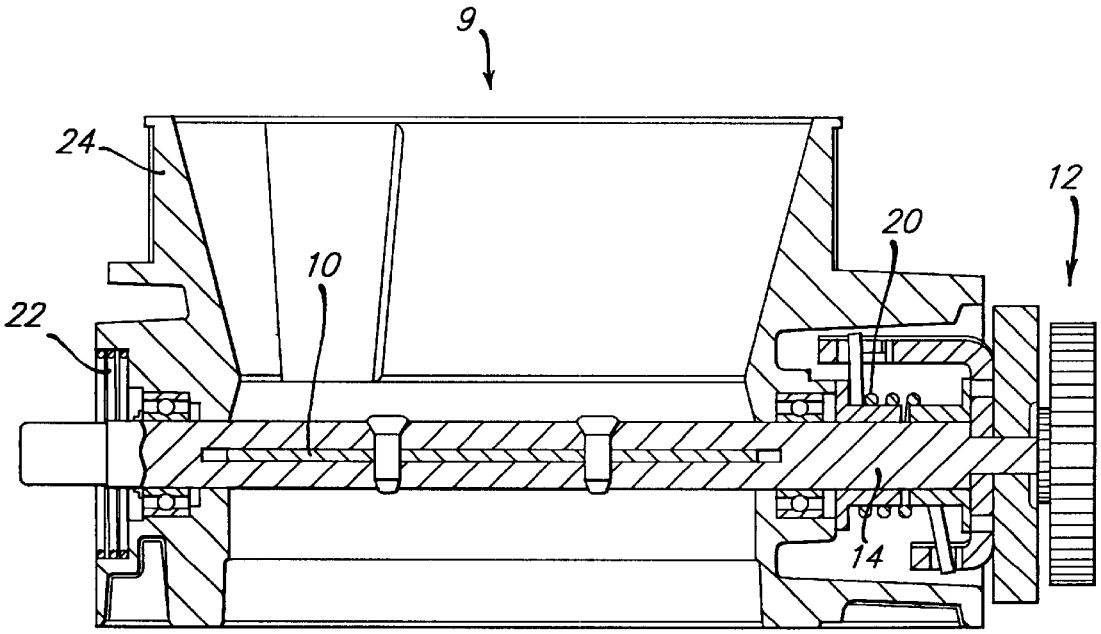
FIG. 2 is a cross-sectional view of a typical throttle plate assembly having opposing return springs.

As shown in FIG. 1, an internal combustion engine 60 has an air intake bore 62 through which intake air flows as needed for engine operation. A throttle plate, valve or blade 10, such as a conventional butterfly valve, is disposed in the bore 62 for regulating the quantity of airflow to the engine. An actuator 64, such as a conventional DC motor or other conventional rotary actuator, is associated with and coupled to the throttle valve 10, such as through a gear set or gear transmission 12 or, as shown in FIG. 2, to a throttle plate shaft 14 which carries the throttle plate 10.

Rotation of the actuator 64 varies the angular position of the throttle plate 10 in the bore to change the degree of opening of the throttle valve, thereby affecting the capacity of the bore 62 to pass air to the engine.

The position of the throttle plate 10, such as the rotary position of a conventional butterfly valve, is sensed by one or more conventional throttle position sensors 66. Such one or more sensors 66 communicate a transduced throttle position signal to a throttle controller 68. This signal may also be communicated to a controller 70, such as a power-train controller.

An accelerator pedal 72 is angularly depressible by the driver to control the speed of the vehicle. One or more conventional accelerator pedal position sensors 74 sense the angular displacement of the accelerator pedal 72. Such one or more sensors 74 provide output that is communicated to the controller 70. Although alternative control arrangements are possible, the present exemplary system utilizes an I/O interface 76 to a central processing unit (CPU) 78. As is conventional, the CPU 78 in the controller 70 executes a control program stored in a memory 80.

The throttle controller 68 controls the application of current to the drive actuator or motor 64 in response to the output of the throttle plate position sensor 66 and the output of the accelerator pedal position sensor 74. Typically, the output signal of the accelerator position pedal sensor 74 is used as a target value indicative of the driver's speed intent. The throttle controller 68 applies current to the motor 64 in one of two polarities to drive the motor 64 and thereby rotate the throttle plate shaft 14 in a desired direction until the throttle plate sensor 66 output corresponds to the accelerator pedal position sensor 74 output.

At least one, and preferably two, opposing return springs 20 and 22 are mounted in a throttle valve body 24 and act on the throttle plate shaft 14 to respectively bias or urge the throttle plate shaft 14 and thereby the throttle plate 10 to a desired preset position in the absence of a motor control signal.

In the control method of the present invention, the preset throttle position, when the drive motor is deactivated, is a default position in the middle of the range of angular movement of the throttle plate 10. With the motor deactivated, the return springs 20 and 22, which act in opposing directions on the throttle plate shaft 14, urge the throttle plate 10 to a default position, shown graphically in FIG. 2, which, by example only, corresponds to a high idle throttle position. This would allow the vehicle to idle under all conditions or to potentially run with reduced power under power management control when the throttle motor is de-energized. In other words, when pedal 72 is at zero or not depressed, the desired throttle is idle; generally this is less than the default condition.

Figure 3:
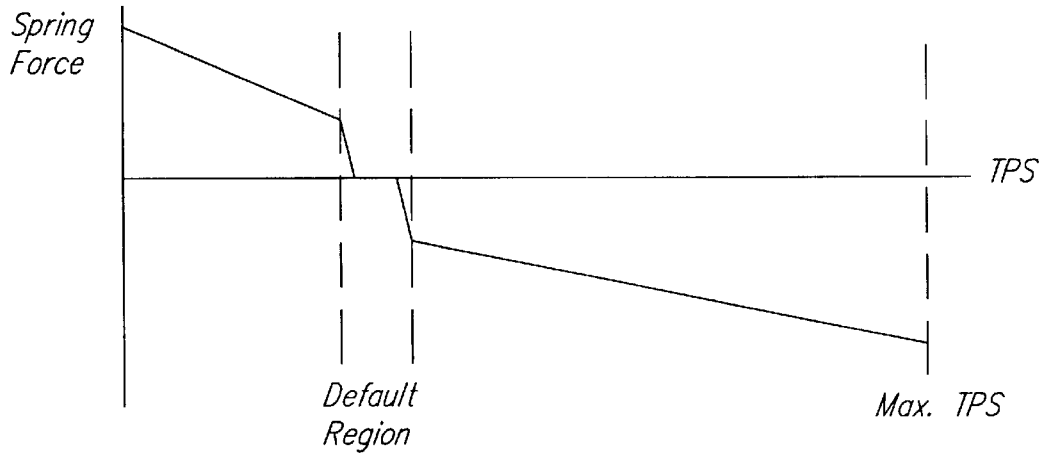
FIG. 3 is a graph depicting spring force versus throttle position.

As shown in FIG. 3, the spring forces exerted by the springs 20 and 22 on the throttle plate shaft 14 are non-linear over the full range of movement of the throttle plate 10 as detected by the throttle plate sensor or TPS. In order to effectively position the throttle plate 10, a control must be designed to counter the non-linearity of the return springs 20 and 22 and, further, to compensate for static friction. Static friction is present when the throttle plate or blade 10 is stationary and results in additional motor torque to move the throttle plate 10 from its stationary position.

Figure 4:
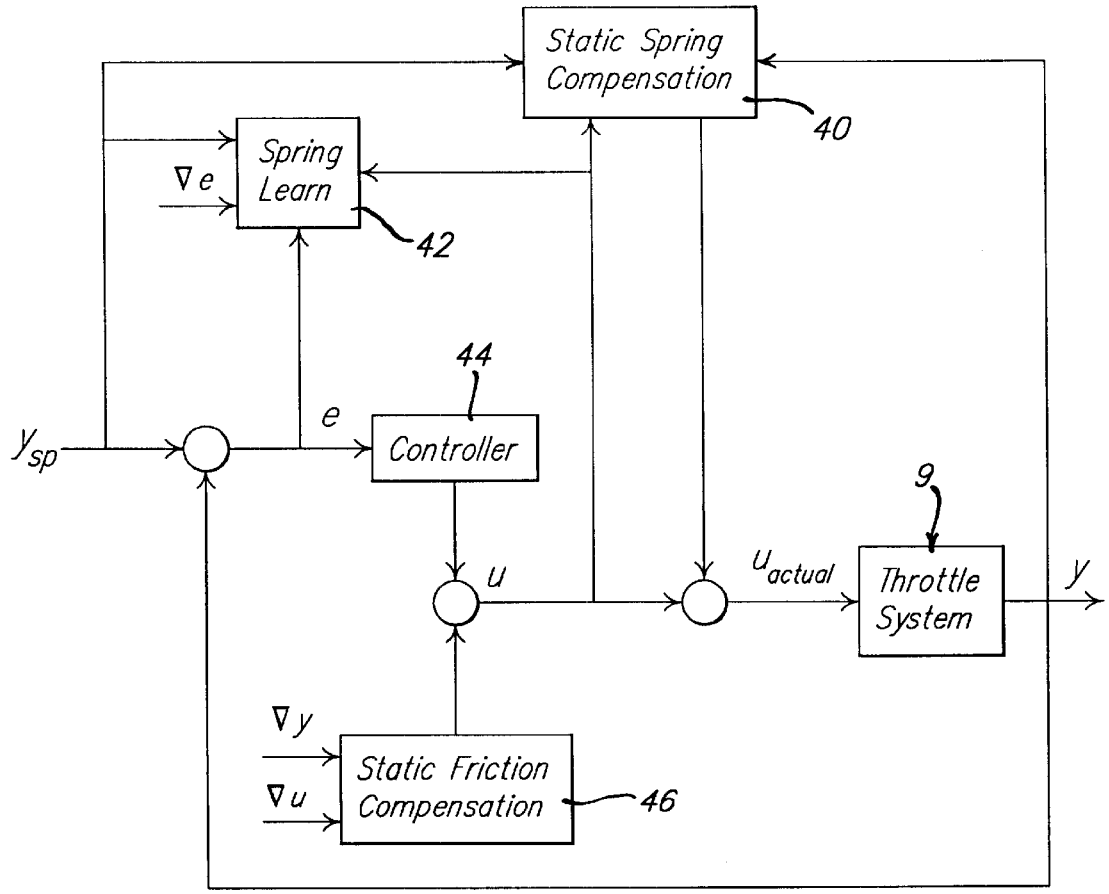
FIG. 4 is a block diagram depicting the control method of the present invention.

The control method and apparatus of the present invention, as shown in FIG. 4, includes three components: spring compensation, which is formed of two components, namely, a feedforward static spring compensation 40 and a feedback non-linear integral action spring compensation 42, a feedback controller 44, typically a PD or PID controller, and a static friction compensator 46.

The variables in FIG. 4 are defined as:

y—throttle position measurement $y_{sp}$—desired throttle position e—filtered throttle position error (filter not shown)

u—control action before spring compensation $\nabla y$—change in throttle position from last sample $\nabla e$—change in throttle position error from last sample $u_{actual}$—control action after spring compensation $\nabla_u$—change in control action from last sample Static Spring Compensation It has been observed that if the throttle plate 10 is not at the default position, there exists a range of motor drive pulse-widths which if commanded in open-loop will not generate enough torque to move the throttle plate 10 away from the default position. However, the motor torque in this range will be sufficient to hold the throttle plate 10 at this constant position. Moreover, under these conditions, it is possible to manually move the throttle plate 10 to other non-default positions where the throttle plate 10 will remain in a constant position.

Figure 5:
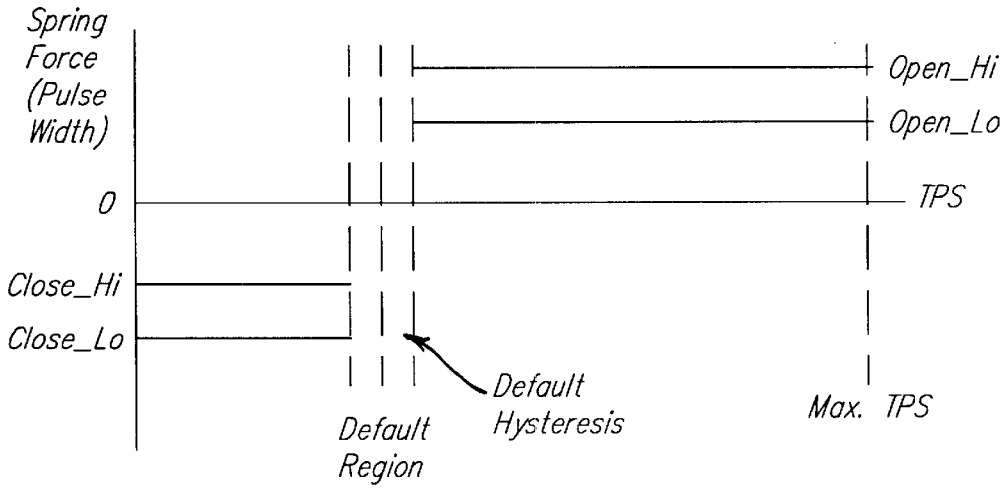
FIGS. 5–7 are graphs depicting various applications of the present method.

A simple model of this observation is shown in FIG. 5 wherein the range above default is bounded by Open_Lo <duty-cycle output<Open_Hi and below the default by Close_Lo<duty-cycle output<Close_Hi. (A negative pulse-width is assumed to command the motor in the closed direction.). Pulse-widths above Open_Hi will cause the throttle plate 10 to open to the maximum stop, pulse-widths between Close_Hi and Open_Lo will result in the throttle plate 10 moving to default, and pulse-widths less than Close_Lo will cause the throttle plate 10 to close to the minimum stop.

In FIG. 5:

Open_Hi is the motor command PWM needed to overcome the spring force preventing the throttle plate 10 from opening when above the default;

Open_Lo is the motor command PWM below which the spring force will drive the throttle plate 10 back to default from a position above the default; Close_Hi is the motor command PWM above which the spring force will drive the throttle plate 10 back to default from a position below the default; and Close_Lo is the motor command PWM needed to overcome the spring force preventing the throttle plate 10 from closing when below the default.

A typical motor position control scheme without return springs would normally use a PD control algorithm. Integral action is not necessary because the motor already acts as an integrator (i.e. a constant command to the motor will lead to an increasing (or decreasing) position). However, using a PD controller for the above-described ETC motor can result in a steady state offset. For example, if one wants to move to and stay at a position above the default, one needs to command a pulse-width between Open_Lo and Open_Hi. But a PD controller can only have a non-zero output if the error is non-zero (i.e. a steady state offset).

There are two potential ways of eliminating the offset. The first is to add integral action into the controller. However, integral action is known to introduce hunting in practical motor control systems. In the ETC case, this has been observed as long small step settling times. This can be intuitively explained because, for example, the throttle may oscillate about the desired position due to tuned overshoot, model inaccuracies, static friction, etc. Since the range of pulse-widths between Open_Hi and Open_Lo for a desired position above the default corresponds to zero control action in the no spring case, the integral action term must change the pulse-width from above Open_Hi to below Open_Lo (or vice versus) to change the throttle movement direction. Depending on the integral gain this may lead to hunting or a long settling time.

The other approach uses feedforward estimates of the spring forces. If the spring forces represented by Open_Hi, Open_Lo, Close_Hi and Close_Lo are accurately known, these values can be used as the feedforward compensators.

The control for static spring compensation is as follows:

```
if setpoint>(default+hyst)
then
if u>0,
spring_comp=Open_Hi
elseif u<0
spring_comp=Open_Lo
else
spring_comp=(Open_Hi+Open_Lo)/2
end
elseif (setpoint<(default−hyst))
if u<0,
spring_comp=Close_Lo
else if u>0
spring_comp=Close_Hi
else
spring_comp=(Close_Hi+Close_Lo)/2
end
else (in default region)
spring_comp=0
end control action after spring compensation u_actual=u+spring_comp
```

where:

setpoint is the desired throttle position hyst is the hysteresis value around the default region default is the default throttle position u is the calculated control action before spring compensation Note that u=0 is interpreted as the control algorithm calling for no throttle movement. To ensure that the throttle blade is held at a constant position, the control torque after spring compensation must lie between Open_Hi and Open_Lo above the default, and between Close_Hi and Close_Lo below default. In this case, the average value is used to decrease or eliminate sensitivity to errors in the Open_Hi, Open_Lo, Close_Hi or Close_Lo values.

Non-Linear Integral Action Spring Compensation

The above spring compensation requires accurate values for the spring forces (e.g. Open_Hi, Open_Lo, Close_Hi, Close_Lo). These values are expected to change with system voltage and temperature as well as with age of the spring. Also, these values are assumed to be constant over the entire regions above and below default. This is not strictly true as the spring force can be a function of compression and the motor force can display ripple. If there are significant errors in these values, unacceptable performance in the form of steady state offsets or limit cycles can result.

Figure 6:
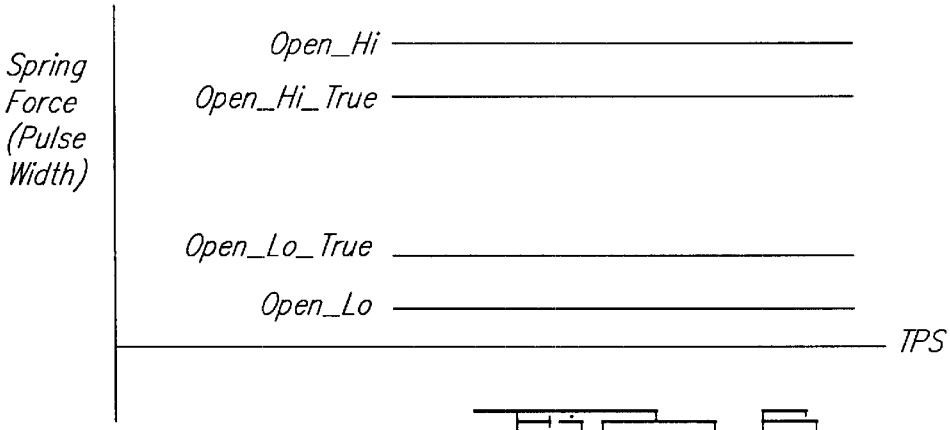
Figure 7:
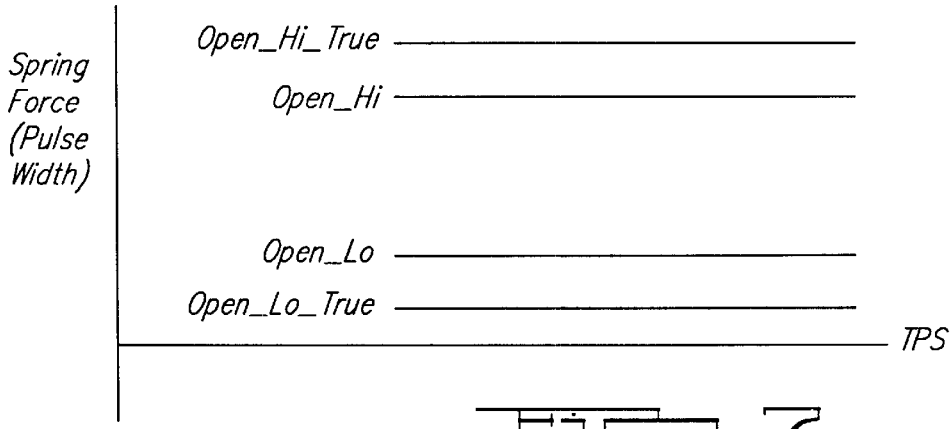
Figure 4:
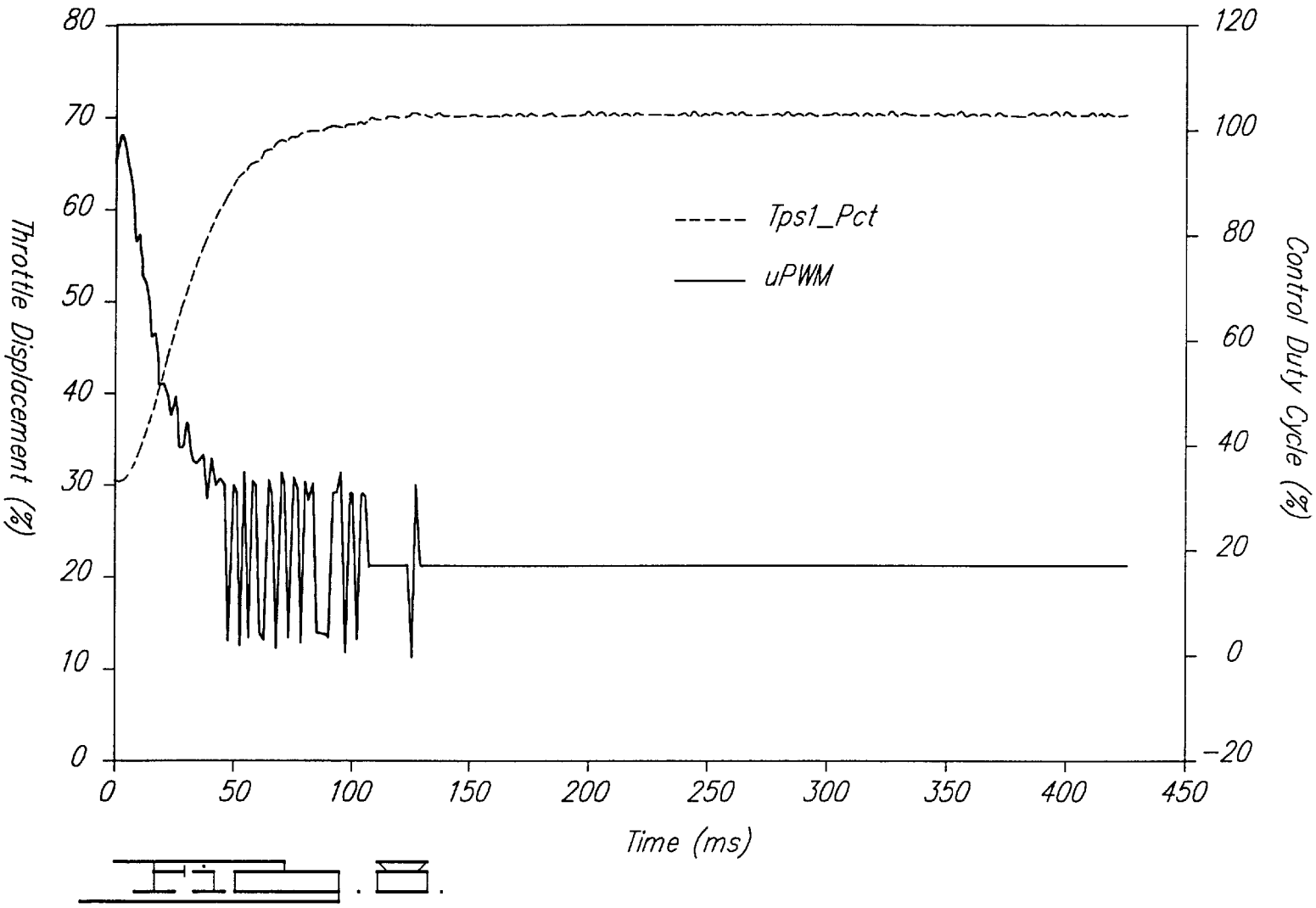

This can be demonstrated in the following examples and FIG. 6. The motor shaft positions the throttle plate 10 above the default and the throttle plate 10 is to be moved to a lower location also above the default.

Define: Open_Hi_True is the true system motor command pulse-width required to overcome the spring force.

Open_Lo_True is the true system motor command pulse-width below which the motor cannot overcome the spring force Case 1) Open_Hi and Open_Lo have values outside their _True values (see FIG. 5).

For this case, the throttle plate 10 would oscillate continually. This oscillation is due to the $u_{actual}$ (the-control action after spring compensation) never being able to take values between Open_Hi_True and Open_Lo_True; the only region where the control action can result in a steady state throttle position.

The oscillations result because, for example, as u>0 approaches zero, $u_{actual}$ approaches Open_Hi. But this value of $u_{actual}$ is larger than Open_Lo_True and will cause the blade to open. Eventually the controller will try to bring the throttle plate 10 back to the desired setpoint position by setting u<0. This results in a $u_{actual}$<Open_Lo, which brings the throttle plate 10 back towards the desired point and restarts the oscillation. The control action may bring the throttle plate 10 through the desired point, so the oscillation will occur above and below the setpoint.

Case 2) Open_Hi and Open_Lo have values inside their _True values (see FIG. 5).

This case will result in an offset between the steady state throttle plate 10 and desired throttle plate position. A non-zero error will result in a non-zero control action u. For example, u<0 implies $u_{actual}$=u+Open_Hi<Open_Hi_True. Since this $u_{actual}$ is below Open_Hi_True, it will not result in enough torque to move the throttle plate 10, only enough to hold its current position, resulting in an offset.

Case 3) Open_Hi>Open_Hi_True

Open_Lo>Open_Lo_True

This case will result in a positive steady state error. As in Case 1), an over estimate of Open_Hi will force the system to overshoot the desired setpoint. Once the system overshoots, the control action eventually reaches a steady state value $u_{actual}$=u+Open_Lo>Open_Lo_True, u<0.

In order to, remove this possibility of steady state offset and/or oscillation from occurring, a way of learning the correct spring compensation factors needs to be incorporated into the system. Adding integral action into the control program helps in removing the offsets of cases 2) and 3). However, integral action will not help in case 1) since the integral action would only serve to change u and could not decrease Open_Hi and increase Open_Lo as required to remove the limit cycle.

Case 1) requires a methodology to learn down Open_Hi and up Open_Lo. This is handled via the following modified integral action procedure. (Updating for Open_Hi is used as an example. The other spring compensation terms are updated in a similar manner.):

```
e(i)=setpoint−actual throttle position
if sign(u) * e(i)<cal.
no action (Here, disable integral action if error is small or sign of control action is opposite sign of error; i.e., control action trying to move throttle away from setpoint, which may occur as error changes sign. It is also possible to disable according to: if overshoot is less than cal.).
else
PW_Intg1Dwn sign(−u) *Kint_dn * MAX((e(i) * (e(i)−e(i−1)), 0)
```

Open_Hi =Open_Hi+PW_Intg1Dwn

Open_Lo =Open_Lo−PW_Intg1Dwn endif where sign(u) is defined as:

if u<0.

sign(u)=−1 elseif u>0 sign(u)=1 else sign(u)=0 endif

MAX(x,y) is defined as:

if x>y x else y endif

Kint_dn is a calibration used to fine tune the learn down rate.

Note that it is also possible to limit PW_Intg1Dwn to a cal according to:

if abs(PW_Intg1Dwn)>cal

PW_Intg1Dwn=sign(PW_Intg1Dwn) * cal endif

MAX ((e(i) * (e(i)−e(i−1)), 0) is always positive and is only non-zero when the throttle is moving towards the setpoint. Therefore, the learn down spring compensation is only done if the throttle plate 10 is oscillating about the setpoint or when throttle plate 10 is first approaching the setpoint.

The learn down procedure has been determined to be more robust if the amount of learning per MCP loop is limited and the learning is disabled until the throttle position overshoots its desired position.

Integral action is implemented if the desired throttle plate 10 position is within the default region. The integral term is only updated if the throttle plate 10 is moving away from the desired setpoint. The maximum allowable change in the integral term is constrained to a threshold. When integral action is enabled, spring compensation learning is disabled and the integral term is added to the PD and static friction compensation portions of the controller via the spring compensation logic.

Static Friction Compensation

When a body is moving, it requires sufficient force to overcome friction. When it is at rest, an additional force is required before it will move. This additional force is static friction. When the controller 44 detects that the throttle plate 10 is at rest and the error is non-zero, an additional pulse-width is supplied until the throttle plate 10 moves. To overcome this friction, if no throttle movement is detected and there is an offset from the desired throttle position, a pulse-width proportional to the current error is added to the normally calculated control action.

The pulse-width is calculated as follows:

PW static=K static * error if (PW static<cal.)

PW_static=cal.

end control action after static friction compensation $u_{actual}$=u+PW_static * sign(u)

Static friction compensation enable conditions are also used to detect if the throttle plate 10 position contains a steady state offset from the setpoint. If a steady state offset exists, the steady state non-zero control action should in theory correspond to the error between Open_Hi and Open_Hi_True (positive steady state error above the default). In this case Open_Hi would be corrected by:

Open_Hi =Open_Hi+K_PW Ofst * u(i)

where K_PW_Ofst is a calibration. While K_PW_Ofst=1 is the theoretical value, it has been found in practice that 1>K_PW_Ofst>0 is needed to maintain stability.

Figure 9:
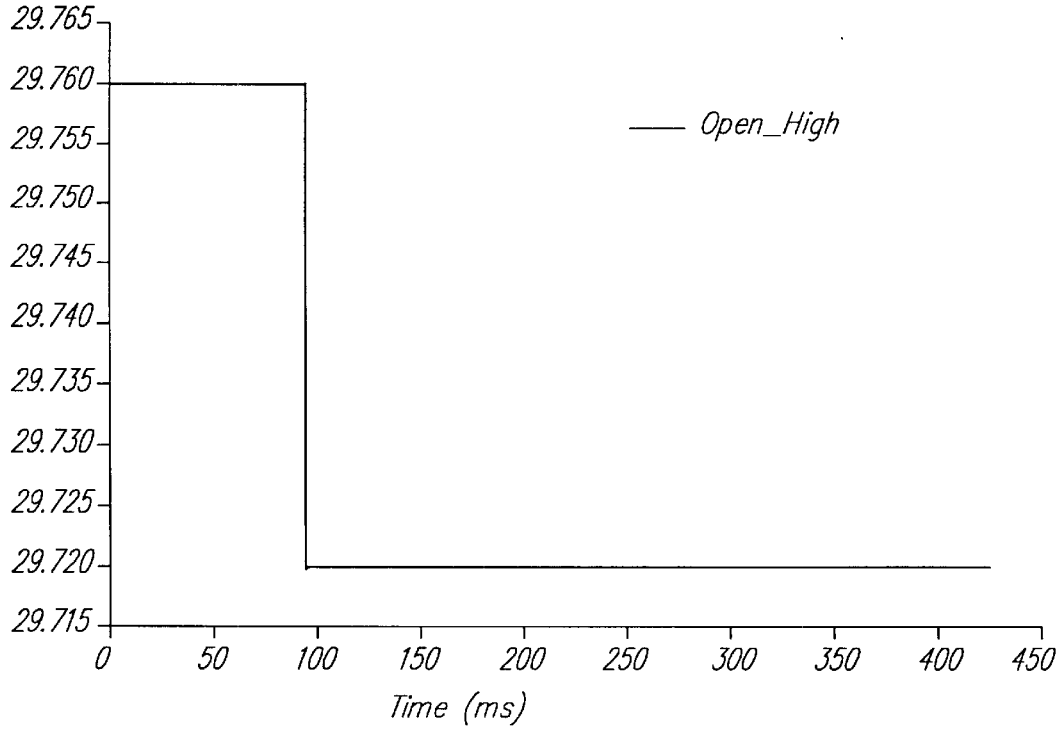
FIGS. 9 and 10 are graphs depicting the spring force learning feature of the present method.
Figure 10:
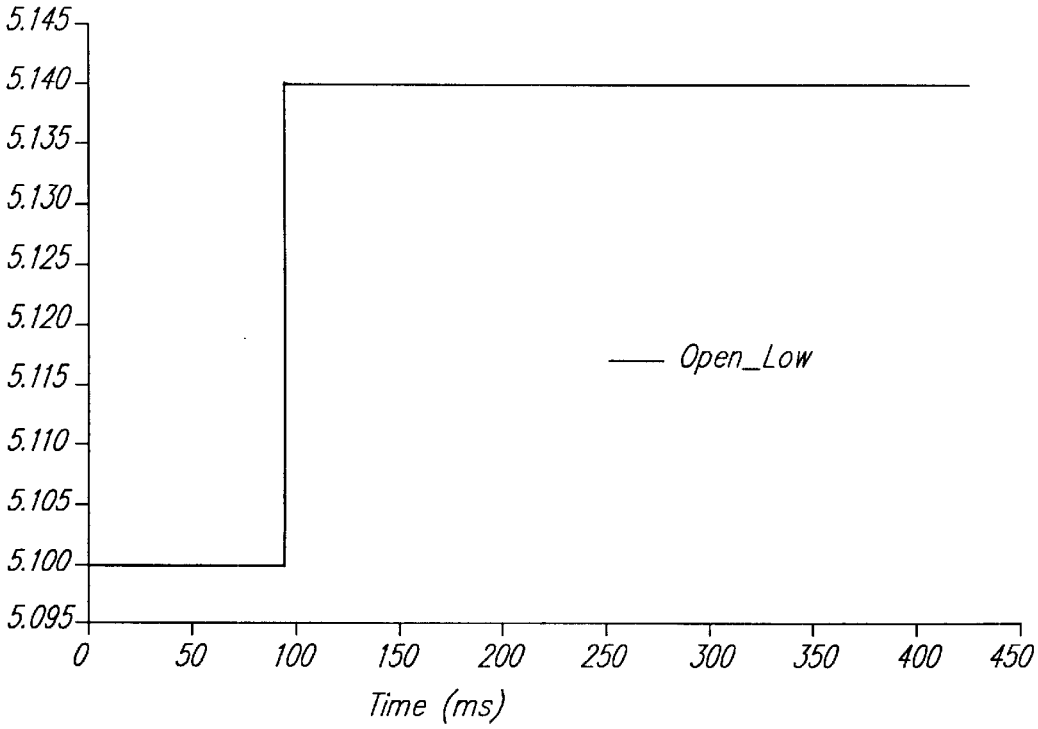

FIG. 8 shows the step response of a throttle to a setpoint change of 30 to 70%. As the throttle plate 10 approaches the final setpoint, the output control duty-cycle oscillates between the Open_Hi and Open_Lo values. The setpoint response is quick, i.e. 80 ms for 95% response with almost no overshoot. FIGS. 9 and 10 show the change in Open_Hi and Open_Lo respectively due to the non-linear integral action spring compensation learning in the course of the change.

What is claimed is:

1. A method for controlling a throttle plate moved by an actuator responsive to accelerator pedal position and throttle plate position, the throttle plate having opposed springs acting on the throttle plate to normally bias the throttle plate to a default position, the method comprising of steps of:

compensating for static friction of the throttle plate when moving the throttle plate to a desired position from rest.

2. The method of claim 1 further comprising the step of compensating for return spring characteristics.

3. The method of claim 2 wherein the step of compensating for the spring characteristics comprises the steps of compensating for at least one of static spring force and non-linear spring action force.

4. The method of claim 2 further comprising the step of:

learning the spring force characteristics over the range of movement of the springs.

5. An apparatus for controlling a throttle plate moved by an actuator responsive to at least one of accelerator pedal position and throttle plate position, the throttle plate having opposed springs acting on the throttle plate to normally bias the throttle plate to a default position, the apparatus comprising:

means for sensing the throttle plate position;

control means for determining a desired throttle position based on at least the present throttle plate position; and means for compensating for static friction of the throttle plate encountered when moving the throttle plate to the desired throttle position from a rest position.

6. The apparatus of claim 5 further-comprising:

means for compensating for return spring characteristics of the opposed springs.

7. The apparatus of claim 6 wherein the return spring characteristics compensating means comprises:

means for compensating for at least one of static spring force and non-linear spring action force.

8. The apparatus of claim 6 further comprising:

means for learning spring force characteristics during movement of the opposed springs.

9. The apparatus of claim 5 wherein the control means is a PID controller.

10. The method of claim 1 further comprising:

determining a throttle control action using a PD controller;

compensating said throttle control action based on estimates of spring forces; and updating spring force compensation of said throttle control action using non-linear integral action.

11. A throttle assembly comprising:

a throttle plate;

an actuator; and a PD controller that determines a throttle control action, that compensates said throttle control action for static friction spring forces from rest to generate a compensated throttle control action, and that signals said actuator to move said throttle plate based on said compensated throttle control action.

12. The throttle assembly of claim 11 wherein said controller updates spring force compensation using a non-linear integral relationship.

13. The throttle assembly of claim 11 wherein said actuator is responsive to at least one of an accelerator pedal position and a position of said throttle plate.

14. The throttle assembly of claim 11 further comprising opposed springs acting on said throttle plate to bias said throttle plate to a default position.

15. The throttle assembly of claim 14 wherein said controller further compensates for return spring characteristics of said opposed springs.

16. The throttle assembly of claim 15 wherein said return spring characteristics include at least one of static spring force and non-linear spring action force.

17. The throttle assembly of claim 14 wherein said controller learns spring force characteristics during movement of said opposed springs.

* * * * *